United States Patent [19]

King et al.

[11] Patent Number: 4,963,788

[45] Date of Patent: Oct. 16, 1990

[54] THIN FILM ELECTROLUMINESCENT DISPLAY WITH IMPROVED CONTRAST

[75] Inventors: Christopher N. King; Richard E. Coovert, both of Portland, Oreg.

[73] Assignee: Planar Systems, Inc., Beaverton, Oreg.

[21] Appl. No.: 218,848

[22] Filed: Jul. 14, 1988

[51] Int. Cl.[5] ..... H05B 33/04; H05B 33/06; H05B 33/28

[52] U.S. Cl. ..... 313/503; 313/505; 313/509; 313/512

[58] Field of Search ..... 313/512, 503, 509, 505

[56] References Cited

U.S. PATENT DOCUMENTS

| | | | |
|---|---|---|---|
| 3,197,664 | 7/1965 | Sentementes et al. | 313/512 X |
| 3,560,784 | 2/1971 | Steele et al. | 313/509 X |
| 4,143,297 | 3/1979 | Fischer | 313/503 X |
| 4,287,449 | 9/1981 | Takeda et al. | 313/509 |
| 4,356,429 | 10/1982 | Tang | 313/503 |
| 4,357,557 | 11/1982 | Inohara et al. | 313/509 |
| 4,417,174 | 11/1983 | Kamijo et al. | 313/503 X |
| 4,547,702 | 10/1985 | Schrank | 313/509 |
| 4,590,128 | 5/1986 | Kawai | 313/512 X |
| 4,670,690 | 6/1987 | Ketchpel | 313/505 |
| 4,672,264 | 6/1987 | Higton | 313/505 X |

FOREIGN PATENT DOCUMENTS

| | | | |
|---|---|---|---|
| 2074787 | 10/1981 | United Kingdom | 313/509 |

OTHER PUBLICATIONS

Ketchpel et al., "Development of an Effective Black Layer for Electroluminescent (EL) Displays," SPIE, vol. 457, Advances in Display Technology IV, (1984).

Abe et al., "AC Thin-Film EL Display with PrMnO3 Black Dielectric Material," Society for Information Display 85 Digest, pp. 215, 217.

Schimizu et al., "High Contrast EL With New Light Absorbing Material GeNx," Japan Display '86.

*Primary Examiner*—Palmer C. DeMeo

*Attorney, Agent, or Firm*—Chernoff, Vilhauer, McClung & Stenzel

[57] ABSTRACT

A TFEL device having improved contrast includes a laminate having a phosphor layer sandwiched between front and rear insulating layers placed upon a substrate supporting a set of front transparent electrodes. The rear set of electrodes are transparent or semitransparent so as not to reflect ambient light toward the viewer. The TFEL laminate is contained within a cavity created by an enclosure secured to the substrate by an adhesive. Darkly dyed filler material is injected into the cavity whose rear inside wall may have a dark coating. The semitransparent electrodes may be made of gold or may be made of transparent indium tin oxide having narrow aluminum bus bars for improved conductivity.

13 Claims, 1 Drawing Sheet

THIN FILM ELECTROLUMINESCENT DISPLAY WITH IMPROVED CONTRAST

The following invention relates to a high efficiency TFEL device for providing an optical display having improved contrast without substantially attenuating the luminance of the panel.

BACKGROUND OF THE INVENTION

Thin film electroluminescent (TFEL) display panels are constructed using a set of transparent front electrodes, typically made of indium tin oxide (ITO), and a transparent phosphor layer sandwiched between transparent dielectric layers situated behind the front electrodes. A rear electrode set is disposed behind the rear insulating layer and is usually constructed of aluminum which provides good electrical conductivity and has a self-healing failure feature because it acts as a localized fuse at breakdown points. Aluminum also enhances the luminance of the display by reflecting back toward the viewer most of the light that would otherwise be lost to the rear of the display. While this reflected light nearly doubles the light of the displayed image, the aluminum electrode also reflects superimposed ambient light that interferes with the display information and reduces the contrast of the display.

To minimize the reflection of ambient light, an antireflection coating is typically used on the front glass. Also, dark backgrounds behind the display are commonly provided. The TFEL laminar stack is situated within an enclosure sealed against the substrate, and the rear wall of this enclosure is usually blackened to block light from extraneous light sources behind the display, and to absorb ambient light passing through the display from the front. Another method of improving the contrast and attenuating the amount of light reflected from the rear aluminum electrodes is to use an external circularly polarized contrast enhancement filter in front of the display. However, such filters can be expensive and typically attenuate the display luminance by 60% or more.

Another approach that has been tried in the past has been to use ITO transparent electrodes for the rear electrode set. This reduces reflectance and allows ambient light to pass on through to the back of the display where it can be absorbed. However, ITO is more resistive than any metallic electrodes such as those made of aluminum, and must be made much thicker to achieve adequate electrical conductivity. Thick layers of ITO do not exhibit the self-healing characteristics of aluminum rear electrodes. This leads to an unacceptable loss in device reliability due to dielectric breakdown.

In yet another approach, shown in Steel et al., U.S. Pat. No. 3,560,784, a light absorbing layer is incorporated into the thin film laminate structure. This reference suggests that if a conventional metallic rear electrode is used, then a light absorbing layer may be added as an insulating layer or as a conductive layer to achieve a black layer display. Insertion of a dark layer immediately behind the phosphor layer, however, can interfere with the phosphor/insulator interface leading to inferior display performance. The light pulse for one polarity may be reduced which can give rise to a flicker effect as well as to a loss in overall brightness.

Another approach has been to utilize a black optically absorbing layer behind the rear insulating layer and in front of the rear aluminum electrode. A similar approach is shown in a device described in U.S. Pat. No. 4,547,702 in which a dark field layer consisting of 6–10% of a noble metal, such as gold, dispersed within a ceramic, such as magnesium oxide, is used between the phosphor and rear insulator or is used as the rear insulator. In either case, the resulting luminance versus voltage characteristic is not steep enough for good matrix display operation, and a higher-than-10% gold content causes excess conductivity resulting in breakdown of the phosphor layer as well as undesirable lateral conduction between electrodes.

In yet another type of proposed device, GeNx is sandwiched as an embedded dark layer within the rear insulator. As with other structures that employ a black layer added between the phosphor layer and the rear electrode, this layer affects the dielectric properties of the insulator, and, hence the reliability of the panel with regard to dielectric breakdown.

SUMMARY OF THE PRESENT INVENTION

The present invention provides an improved contrast display for a TFEL panel which includes a substrate supporting a laminar thin film structure including a set of transparent front electrodes, a phosphor layer sandwiched between front and rear insulating layers, and a semitransparent set of rear electrodes that exhibits good self-healing characteristics deposited on the rear insulating layer, all contained within an enclosure sealed against the substrate. The cavity thus formed includes within it an optically absorbent material such as a dark fluid for absorbing ambient light to improve the contrast of the display.

The thin transparent rear electrodes may be made of gold and the optically absorbent material may include a black dye dissolved in silicone oil or a solid filler material injected into the cavity. Additionally the optically absorbent material may include a black coating which is deposited on the rear wall of the enclosure inside the cavity.

As an alternative embodiment, the rear electrodes may be totally transparent. Totally transparent electrodes such as those made from indium tin oxide (ITO) however, have poor conductivity if made thin enough to exhibit self-healing characteristics. Thus, a narrow bus bar made of aluminum or some other highly conductive and self-healing material may be provided which extends colinearly, and in contact with, each electrode. The bus bars are narrow, having a width of between 5% and 25% of each respective ITO electrode. To provide good electrical contact and adhesion, a thin chromium strip may be interposed between each bus bar and its corresponding electrode.

In either case the electrodes will appear to be transparent or nearly transparent and will not reflect ambient light back toward the viewer as conventional rear electrodes do. This will allow the ambient light to be absorbed by the dark filler material in the cavity behind the rear electrodes.

It is a principal object of this invention to provide an AC TFEL display device having improved contrast while at the same time maintaining high efficiency without substantially attenuating the luminance of the display.

A further object of this invention is to provide a TFEL panel having improved contrast utilizing transparent or semitransparent rear electrodes with an optically absorbent material interposed behind the electrodes.

Yet a further object of this invention is to provide an improved contrast TFEL panel having adequate luminance, high electrical reliability and high efficiency utilizing a transparent or semitransparent rear electrode structure having good self-healing characteristics.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
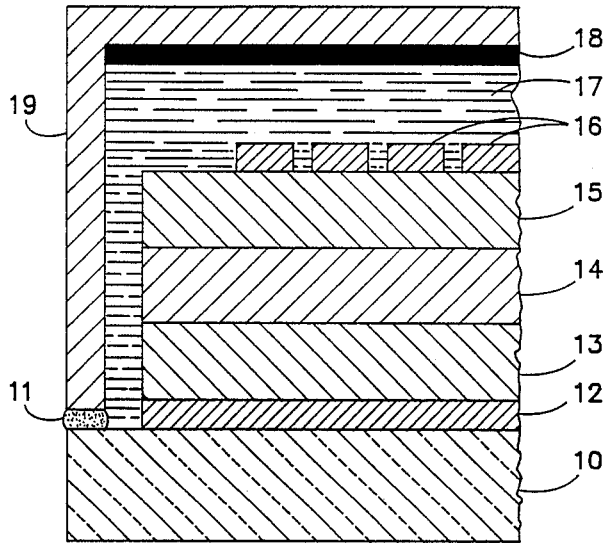
FIG. 1 is a partial cutaway view of a TFEL device constructed according to the invention employing semitransparent rear electrodes.

Referring to FIG. 1, a TFEL device includes a glass substrate 10 supporting a laminar stack comprising the TFEL display elements. The stack includes a set of transparent front electrodes 12 and a sandwich structure including a phosphor layer 14 sandwiched between front and rear insulating layers 13 and 15, respectively. Semitransparent rear electrodes 16 are deposited on the rear insulator 15 and extend in a direction perpendicular to the transparent front electrodes 12 so that pixel points of light are created when electrodes in both sets are energized simultaneously. The semitransparent rear electrodes 16 may be fabricated from gold, and as such, provide high conductivity but do not reflect ambient light back toward the viewer to the same degree that aluminum electrodes would. The gold electrodes exhibit the self-healing characteristics of aluminum and are highly conductive, thus providing good electrical reliability and high efficiency without high reflectance from the rear electrode layer.

The TFEL components are sealed against the substrate 10 by an enclosure 19 which may be affixed to the substrate 10 by any suitable adhesive 11. An optically absorbent material may be injected into the cavity defined by the enclosure 19 to further absorb ambient light. This may take the form of a silicone oil 17 which is conventionally used as a filler material or a solid filler of the type disclosed in Ser. No. 104,166 entitled "Seal Method and Construction for TFEL Panels Employing Solid Filler" and assigned to the same assignee. This silicone oil 17 may include a black dye to make it optically absorbent. Optical absorption is also enhanced by providing a black coating 18 on the rear inside cavity wall of the enclosure 19.

Figure 2:
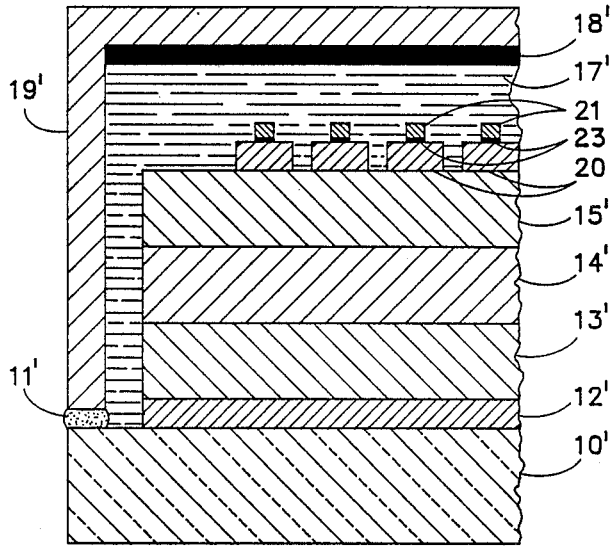
FIG. 2 is a partial cutaway view of a TFEL device constructed according to the present invention and including transparent rear electrodes having auxiliary bus bars.

An alternative embodiment is shown in FIG. 2 which includes all the components of FIG. 1 with the exception that the rear electrodes are transparent. Phosphor layer 14' is sandwiched between insulators 13' and 15' and are supported by electrode layer 12' on glass substrate 10'. Transparent rear electrodes 20 may be fabricated from indium tin oxide (ITO). The conductivity of ITO, however, is significantly less than the conductivity of gold. To compensate for its poor conductivity, the ITO electrodes are each provided with bus bars 21 made of aluminum which extend colinearly with each electrode and in contact with it. Each bus bar 21 typically has a width ranging from 5% to 25% of the width of the ITO electrode 20. To improve adhesion a thin chromium strip 23 interposed between the bus bar and the ITO electrode may be used. For example, the bus bar may have a thickness of 900 Å and the chromium strip may have a thickness of 100 Å. The bus bars 21 enable the ITO electrodes 20 to be made thin enough so that they exhibit the same self-healing properties as aluminum or gold while compensating for the loss in conductivity. For greater conductivity thin gold may also be used in place of ITO with the aluminum bus bars 21.

As with the emobodiment of FIG. 1, a filler 17' which may be black-dyed silicone oil is inserted into a cavity formed by enclosure 19' secured to the substrate 10' with adhesive 11'. A black coating 18' is placed on the rear inner wall of the enclosure 19'.

Figure 3:
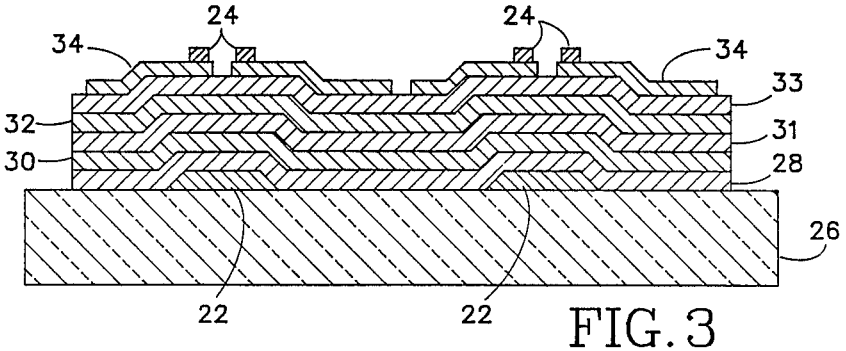
FIG. 3 is a partial cutaway view of a TFEL device showing a further refinement of the invention as shown in FIG. 2 employing light absorbing stripes to attenuate reflectance from the rear bus bars with which they are optically aligned.

A further improvement in the alternative form of the invention (Refer to FIG. 3) is to include an additional patterned light absorbing film 22 directly in front of the reflective bus bars 24 backing transparent conductors 34 to reduce or eliminate the reflection of ambient light from the bus bars. This film can be located at any level in the thin film stack, but the recommended location is to deposit it as the first film on the substrate 26. To maximize the optical transmission of the overall display, the film 22 need only be in front of each bus bar 24, and therefore can be patterned so that the light absorbing film 22 is removed between the bus bar locations. If desired, a buffer layer 28 of transparent insulating material, such as aluminum oxide or silicon nitride, may be deposited over the patterned light absorbing film 22, to avoid any reaction with the next deposited transparent conductor layer 30, which is typically indium tin oxide. With this configuration for the light absorbing film 22, it is isolated electrically from the subsequently deposited conductors 30, and therefore does not compromise the electrical characteristics of the light emitting stack comprising insulators 31 and 33 sandwiching phosphor layer 32. The light absorbing layer therefore, does not need to have any particular electrical requirements.

The light absorbing stripes 22 may be optically opaque or may constitute a partially transmissive filter, with either neutral density or wavelength-selective filtering. For a multicolor display, the light absorbing transmission characteristics can be matched to the emitted light, i.e., a red transmitting filter may be used in front of a red emitting area bus bar, etc., to substantially preserve the emitted light while substantially blocking the ambient light reflected from the bus bar. Even in the case of a neutral density filter with transmission T, the display contrast can be improved because the emitted light is reduced by the factor T, whereas the ambient light fraction R, reflected from the bus bar, is reduced by $T^2$ due to absorption on both the inward and outward passage of the reflected light path.

The light absorbing stripes 22 can be deposited on the surface of the substrate 26. If the stripes 22 are thick, they can be tapered at the edges for better step coverage of subsequent layers. In the alternative the substrate 26 may be prepared with recesses or channels to receive the stripes 22. This may be necessary if the stripes are very thick where it may be difficult to provide tapered edges.

The stripes 22 are positioned on the substrate to lie in front of, that is along the optical line of sight, of a viewer viewing the panel from in front of the substrate 26. The bus bars 24 are positioned toward respective edges of the electrodes 34 so that one stripe 22 may effectively lie in front of each two bus bars 24. This obviates the need for depositing a large plurality of very thin light absorbent stripes on the substrate.

If desired, a circularly polarized filter (not shown) may be used with the structure of FIG. 1 to further reduce the reflected light and to achieve acceptable contrast in high ambient light conditions. Circularly polarized filters, however, have the effect of attenuating the luminance of the panel by as much as 60%. Nevertheless, in high ambient light conditions, such a filter may be desirable.

The contrast ratio of a display is defined as the ratio of the luminance of the display when it is "on" to its luminance when it is "off." Any illumination adds to both conditions so that the contrast ratio is equal to the "on" luminance plus the background illumination times the reflectance divided by the "off" luminance plus the background illumination times the reflectance. A standard TFEL panel with no filter conventionally provides a luminance of 20 fL and has a diffuse reflectance of 10%, so that with a background luminance of 1000 fc, its contrast ratio is 1.2. By comparison, a panel employing transparent gold electrodes as disclosed herein provides a contrast ratio of 1.86 and a luminance of 14 fL. The structure of the invention therefore provides a significant increase in contrast with only a moderate penalty in luminance.

If a circularly polarized filter with 35% transmission is added to the standard display to improve its contrast, the result is a luminance of 7 fL and a contrast ratio of 1.98. In comparison, the panel disclosed herein, without any filter, has nearly comparable contrast (1.86) but provides twice the luminance (14 fL).

Application of the circularly polarized filter to the panel disclosed herein reduces its luminance to 4.9 fL but raises the contrast ratio to 6.1. That is, when circular polarizer filters are used on both panels, the gold electrode panel provides three times as much contrast and 70% of the luminance of the standard panel. Therefore, depending upon the filter configuration, the panel disclosed can provide either improved luminance or superior contrast to a standard panel.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a TFEL device for providing an optical display, a substrate supporting a laminar thin film re including a set of transparent front electrodes and a phosphor layer sandwiched between front and rear insulating layers, the improvement comprising:

(a) a set of at least semitransparent rear electrodes deposited on said rear insulating layer;

(b) a set of conductive bus bars arranged colinearly and in contact with each electrode in said set of transparent rear electrodes; and (c) enclosure means sealed against said substrate for defining a cavity enclosing said laminar thin-film structure, said cavity including within it an optically absorbent material disposed behind the rear electrode set for absorbing ambient light to improve the contrast of the optical display.

2. The TFEL device of claim 1 wherein said set of at least semitransparent rear electrodes is made of indium tin oxide.

3. The TFEL device of claim 1 wherein the bus bars are made of aluminum.

4. The TFEL device of claim 3 further including a chromium strip interposed between each aluminum bus bar and its corresponding electrode.

5. The TFEL device of claim 4 wherein each said chromium strip has a thickness on the order of 100 Å and each aluminum bus bar has a thickness on the order of 900 Å.

6. The TFEL device of claim 1 wherein the optically absorbent material comprises a black dye dissolved in filler material occupying the cavity.

7. The TFEL device of claim 6 wherein the filler material is a silicone oil.

8. The TFEL device of claim 7 wherein the optically absorbent material further comprises a black coating deposited on a rear wall of the enclosure means inside said cavity.

9. The TFEL device of claim 1 further comprises light absorbent stripes disposed on the substrate and optically aligned with each bus bar.

10. The TFEL device of claim 9 wherein the bus bars are positioned toward edges of their respective electrodes whereby one light absorbent stripe is optically aligned with a pair of bus bars.

11. The TFEL device of claim 9 further comprising a thin film buffer layer interposed between the transparent front electrodes and the light absorbent stripes.

12. The TFEL device of claim 9 wherein the light absorbent stripes have tapered edges.

13. The TFEL device of claim 1 wherein said set of rear electrodes is made of gold.

* * * * *

UNITED STATES PATENT AND TRADEMARK OFFICE

CERTIFICATE OF CORRECTION

PATENT NO. : 4,963,788

DATED : October 16, 1990

INVENTOR(S) : Christopher N. King and Richard E. Coovert

It is certified that error appears in the above-identified patent and that said Letters Patent is hereby corrected as shown below:

Column 1, lines 28-29: change "antire-flection" to --anti-reflection--.

Column 6, line 5: change "re" to --structure--.

Signed and Sealed this

Fourteenth Day of July, 1992

*Attest:*

DOUGLAS B. COMER

*Attesting Officer*

*Acting Commissioner of Patents and Trademarks*